US005158020A

United States Patent [19]

Kunczynski

[11] Patent Number: 5,158,020

[45] Date of Patent: Oct. 27, 1992

[54] DRIVE SHOE ASSEMBLY WITH RESILIENTLY FLEXIBLE TRACTION MEMBERS AND METHOD

[75] Inventor: Jan K. Kunczynski, Glenbrook, Nev.

[73] Assignees: Zygmunt Alexander Kunczynski; Alexander Jan Kunczynski, both of Carson City, Nev.

[21] Appl. No.: 698,667

[22] Filed: May 10, 1991

[51] Int. Cl.[5] ..... B61B 13/00

[52] U.S. Cl. ..... 104/168; 104/184

[58] Field of Search ..... 104/163, 168, 165, 178, 104/184, 202, 173.1; 198/833, 834, 835

[56] References Cited

U.S. PATENT DOCUMENTS

| | | | |
|---|---|---|---|
| 482,469 | 9/1892 | Cook | 104/168 |
| 496,183 | 4/1893 | Cook | 104/168 |
| 2,905,101 | 9/1959 | Sinden | 104/25 |
| 3,039,402 | 6/1962 | Richardson | 104/168 |
| 3,596,607 | 8/1971 | Pomagalski | 104/168 |
| 3,662,691 | 5/1972 | Goirand | 104/173 |
| 3,685,457 | 8/1972 | Wallmannsberger | 104/205 |
| 3,735,710 | 5/1973 | Hickman | 104/168 |
| 3,759,188 | 9/1973 | Woods | 104/168 |
| 3,871,303 | 3/1975 | Woodling | 104/168 |
| 3,880,083 | 4/1975 | Grant | 104/168 |
| 4,050,385 | 9/1977 | Gurr et al. | 104/173 |
| 4,078,499 | 3/1978 | Giraud | 104/165 |
| 4,152,992 | 5/1979 | Mackintosh | 104/168 |
| 4,361,094 | 11/1982 | Schwarzkopf | 104/168 |
| 4,368,037 | 1/1983 | Linque et al. | 104/168 |
| 4,563,955 | 1/1986 | Tarassoff | 104/168 |
| 4,658,733 | 4/1987 | Kunczynski | 104/208 |
| 4,671,186 | 6/1987 | Kunczynski | 104/168 |
| 4,744,306 | 5/1988 | Kunczynski | 104/168 |
| 4,794,864 | 1/1989 | Feuz et al. | 104/168 |
| 4,860,664 | 8/1989 | Kunczynski | 104/204 |

FOREIGN PATENT DOCUMENTS

| | | | |
|---|---|---|---|
| 125967 | 11/1984 | European Pat. Off. . | |
| 1131718 | 6/1962 | Fed. Rep. of Germany . | |
| 1505985 | 8/1969 | Fed. Rep. of Germany | 104/168 |
| 2060030 | 6/1972 | Fed. Rep. of Germany . | |
| 1354297 | 1/1964 | France . | |
| 1453517 | 9/1966 | France . | |
| 1300029 | 6/1982 | France . | |
| 2496029 | 6/1982 | France . | |
| 0244600 | 2/1926 | Italy | 104/168 |
| 0301453 | 12/1989 | Japan | 104/163 |

*Primary Examiner*—Matthew C. Graham
*Assistant Examiner*—Mark T. Le
*Attorney, Agent, or Firm*—Flehr Hohbach Test Albritton & Herbert

[57] ABSTRACT

As drive shoe assembly (50) for a transportation system in which transport units (31) are propelled along a path by frictional engagement of the drive shoe assembly (50) by a drive assembly (36). The drive shoe assembly (50) includes frame members (54) and a plurality of resiliently flexible traction members (52) disposed therebetween defining a resiliently flexible traction surface (60). The traction surface (60) is coupled to the frame members (54) and, further, is positioned to be frictionally engaged by a plurality of drive wheels (36) in a sequence situated along the path to propel the transport unit (31) forward. Upon engagement between the drive wheels (36) and the traction surface (60), the resilient traction surface (60) is sufficiently deflected such that any ice accumulation on the resilient members (52) will crack and fall away. The resilient traction surface (60) allows the use of solid tires (36), affords damping against lateral swinging of the units (31), and accommodates acceleration and deceleration without tire-shoe slipping. A method of avoiding detrimental ice build up on drive shoes, as well as lateral swing damping, acceleration accommodation, and tire wear reduction.

28 Claims, 6 Drawing Sheets

DRIVE SHOE ASSEMBLY WITH RESILIENTLY FLEXIBLE TRACTION MEMBERS AND METHOD

TECHNICAL FIELD

The present invention relates, in general to transportation systems in which passive transport units are propelled along a path by frictional drive assemblies that engage a traction surface on the unit. More particularly, the invention relates to traction or drive shoe assemblies of the type frequently employed on aerial tramway systems, which have chairs, cabins, gondolas or the like, that are detached from the haul rope and are driven along rails by drive assemblies.

BACKGROUND OF THE INVENTION

Various transportation systems have been developed in which a passive transport or conveying unit is propelled along a path or track by frictional engagement of the unit by a frictional drive assembly. The drive assembly most commonly used is a series of wheels which sequentially engage the transport unit and drive it along the track or path. In some systems the drive assembly simply engages a portion or traction surface on the body of the transport unit. Other transport systems employ a traction structure or drive shoe which is carried by the transport unit and engaged by drive wheels, gears or belts.

At least two common broad types of transport systems employing device shoe assemblies are well known, namely, general purpose transportation systems in which passive units are driven over the length of the system and haul rope-based aerial tramway systems in which detached units are moved over short distances. Typical of a general purpose transportation system employing transport units with drive shoes and frictional driving assemblies is the transportation system disclosed in my U.S. Pat. No. 4,671,186. In my patent, drive wheels or gears engage a drive shoe mounted on the side of the cabin of a transport unit. The drive shoes are rigid or substantially inflexible, but they can be resiliently mounted and biased toward the drive wheels to smooth propulsion of the transport units.

Other prior art general purpose transport systems in which drive wheels, gears or belts engage and frictionally propel transport units are disclosed in U.S. Pat. Nos. 4,368,037; 4,152,992; 4,078,499; 3,880,088; 3,871,303; 3,759,188; 3,735,710; 3,039,402; 2,905,101; 496,188 and 482,469; and French Patent Nos. 1,354,297 and 1,300,029. In each of these systems the assembly or portion of the transport unit engaged by the frictional drive means is a relatively inflexible or rigid traction surface.

There are two general categories of aerial tramway haul rope grip assemblies in widespread use, namely, those with detachable grip assemblies and those with permanently affixed grip assemblies. As used henceforth, the expression "aerial tramway" shall be understood to include any haul rope-based conveying system of the type transporting a plurality of passengers or cargo carrier units (e.g., chairs, gondolas, cabins, platforms) secured to a haul rope to enable those units to be conveyed along a path. Detachable grip assemblies are regularly removed from the tramway haul rope, usually to permit the transport unit to be slowed down below the haul rope speed for ease, comfort and safety of loading and unloading at the tramway terminals or stations.

Typical of an aerial tramway system in which detached passive transport units are conveyed along a track or rail is the tramway of my U.S. Pat. No. 4,744,306. Such aerial tramways advantageously employ detachable grip assemblies which also carry a drive shoe or traction member that is engaged by drive wheels. My U.S. Pat. Nos. 4,658,733 and 4,860,664 disclose combined detachable grip and drive shoe assemblies of the type which may be employed in aerial tramways.

The detachable grip assembly of my U.S. Pat. No. 4,860,664 is illustrated in FIG. 1 of the present drawing. In this tramway system the detached carrier unit is propelled around the tramway terminal on rails by drive tires on wheels at a speed much slower than the haul rope. The drive wheels provide a means for accelerating and decelerating the carrier unit at the terminal for loading and unloading of passengers.

When disengaged from the haul rope, this detachable grip assembly, generally designated 30, and their carrier units (not shown), are normally supported at the tramway terminals by rolling elements, such as rollers 32, which travel along a path defined by guide rails 34, shown in FIG. 2. To propel grip assembly 30 along guide rails 34, an upwardly facing traction drive shoe assembly 38, mounted to grip assembly 30 and having a relatively rigid traction surface 40, engages with a plurality of stationary, sequenced, rotatable wheels 36 positioned along guide rails 34. Rigid traction shoes are old in the art and are commonly employed for the above-mentioned purpose. Drive shoe assembly 30 is urged around the terminal at a speed proportional to the angular velocity of drive wheels 36. Thus, in order to propel the carrier unit around the terminal, via drive shoe assembly 38, the coefficient of friction between rotatable wheels 36 and traction surface 40 must be sufficient enough to enable proper movement along the provided path.

One constantly reoccurring problem in aerial tramway transport systems employed in cold and snowy environments is that snow and ice can build up on the traction surfaces used to propel the transport units. For wheel-driven systems that engage horizontally oriented, upwardly facing drive shoes, such as shoe 38, the problem occurs when ice builds up on drive shoe 38. Ice build-up can be so severe that the units cannot be moved along even relatively level rails 34.

For aerial tramways the approach most frequently taken to reduce this problem is to brush or clean drive shoe 38. For example, in the aerial tramway system of U.S. Pat. No. 4,563,955 snow scrapers and powered rotating brushes are mounted above and at an angle to the drive shoe to sweep snow and debris off the shoe or friction plate. While effective for snow, such systems are less reliable and relatively ineffective in removing ice. Thus, even when brushes are used, weather can ice-up and close down tramway systems, which, of course, is highly undesirable in applications such as are common in the skiing industry.

Another problem associated with aerial tramway transportation systems occurs when one or more of drive wheels 36 deflates. A deflated tire is analogous to an excessive accumulation of ice on traction surface 40. That is, a deflated tire lacks sufficient rigidity to enable wheel 36 to propel drive shoe assembly 38 forward. The carrier unit may become delayed or stalled in these areas of deflation. Since an aerial tramway having detachable grip assemblies may employ more than 200 inflatable tires, even a small percentage of deflations can be significant, especially if two or more consecutive tires are deflated.

A simple solution to the deflation problem would seemingly be to replace inflatable wheels 36 with solid or relatively rigid tires. Solid rubber tires, for example, are relatively maintenance free, more durable and less costly. Unfortunately, because traction surface 40 of drive shoe assembly 38 is relatively rigid, the resilient inflatable tires 36 are highly desirable to absorb excess energy created when engagement occurs. Moreover, the cabins or chairs often are swinging in a direction lateral to the haul rope when they enter the terminals, and resilient inflatable tires cooperate with the rigid drive shoes to damp lateral sway or swinging. Accordingly, drive wheels 36 are provided as inflatable tires because of their resilient properties.

Lastly, drive wheels 36 operating near the entrance or exit of the terminal are driven at differing angular velocities to accelerate or decelerate the carrier units. That is, consecutive wheels 36 operating at different speeds gradually accelerate and decelerate the carrier unit as rigid traction surface 40 engages wheels 36. During acceleration and deceleration it is further desirable to maintain traction surface 40 in constant engagement with at least one drive wheel 36, to potentially reduce stalling between wheels 36. Thus, the length of traction surface 40 preferably spans the distance between two adjacent wheels 36 along the path so that two consecutive wheels 36 will simultaneously engage rigid traction surface 40 for a short time as the drive shoe advances from one wheel to another. However, in an accelerator or decelerator when simultaneous engagement occurs, slippage on surface 40 also must occur at one or the other wheel 36 because of the difference in angular velocities between two adjacent engaging wheels 36. Although wheels 36 are semi-pliable, such resiliency is inadequate to compensate for the relative rigidity of traction surface 40. Such resulting slippage promotes tire deflation, as well as accelerating tire wear and replacement. This problem of tire wear in accelerators and decelerators has been addressed by providing drive wheels that are mounted on spring biased axle assemblies which permit limited angular displacement during driving when adjacent drive wheels fight each other while simultaneously engaging the drive shoe. Such drive wheel mounting assemblies, however, do add to the overall cost of accelerators and decelerators.

Other examples of aerial tramway systems employing drive wheels to propel detached passenger carrier units are shown in U.S. Pat. Nos. 4,050,385; 3,685,457; 3,662,691 and 3,596,607; and German Patent No. 1,505,985; European Patent No. 0,125,967; French Patent Nos. 2,496,029 and 1,453,517; and German Patent Nos. 1,131,718 and 2,060,030. As is true of the general purpose transport systems, these aerial tramway systems are based upon frictional engagement between a drive assembly and a rigid drive or traction surface. In some instances, however, a rotatable drive member is carried by the transport unit but it is effectively fixed or rigid in its relationship to the chair, gondola or cabin.

OBJECTS AND DISCLOSURE OF INVENTION

A. Objects of the Invention

Accordingly, it is an object of the present invention to provide a drive shoe assembly and method for an aerial tramway or general purpose transportation system which is constructed in a manner preventing the build-up of ice on traction surfaces.

Another object of the present invention is to provide a drive shoe assembly and method suitable for use in tramway systems having detachable grip assemblies which provides damping of and lateral sway or swinging between the drive shoe and the drive wheels.

Still a further object of the present invention is to provide a drive shoe assembly and method which can be used in conjunction with relatively rigid, uninflated drive wheels without damaging the wheels or the drive shoe.

It is yet another object of the present invention to provide a drive shoe assembly and method which will accommodate the difference in angular velocities between two consecutive driven wheels simultaneously engaging the shoe assembly in an accelerator or decelerator.

It is a further object of the present invention to provide a drive shoe assembly which is durable, compact, easy to maintain, and is economical to manufacture The assembly and method of the present invention has other objects and features of advantage which will become apparent from and are set forth in more detail in the description of the Best Mode of Carrying Out the Invention and the accompanying drawing.

B. Disclosure of Invention

In summary, the drive shoe assembly of the present invention is particularly suitable for use with aerial tramways employing detachable grip assemblies. The improvement in the drive shoe assembly of the present invention comprises, briefly, a traction means provided by a resiliently flexible traction assembly.

The resiliently flexible surface must be sufficiently flexible and preferably open to produce cracking and falling away of any ice present on the traction assembly upon frictional engagement and flexing of the traction assembly by the frictional drive means. Further, because of the resiliency of the traction surface, the drive wheels may be relatively rigid and uninflated. This eliminates the problem of drive wheel deflation. Moreover, the resilient drive shoe assembly cooperates with relatively rigid tires to provide smooth engagement with the drive wheels and lateral damping of swinging. Additionally, drive shoe resiliency and flexibility accommodates differences in angular velocity between adjacent drive wheels in accelerators and decelerators.

The method of providing a drive system for an aerial tramway, or the like, which will not permit the build-up of ice, will permit the use of solid tries, will afford damping and will accommodate differing drive wheel speeds comprises briefly, the step of mounting a resilient traction surface to the transport unit for engagement by drive wheels of a drive assembly.

The resilient traction drive shoe assembly and method constructed in accordance with the present invention will be described in more detail below in conjunction with the accompanying drawing.

BRIEF DESCRIPTION OF THE DRAWING

Additional objects and features of the invention will be more apparent from the following detailed description and appended claims when taken in conjunction with the drawing, in which:

BEST MODE FOR CARRYING OUT THE INVENTION

Reference will now be made in detail to the preferred embodiments of the invention, examples of which are illustrated in the accompanying drawings. While the present invention has been described with reference to a few specific embodiments, the description is illustrative of the invention and is not to be construed as limiting the invention. Similarly, although primarily constructed for use with aerial tramway employing detachable grip assemblies, the drive shoe assembly and method of the present invention is applicable to a variety of general purpose transportation or carrier systems utilizing a traction surface to propel a transport unit along a predetermined path. Various modifications may occur to those skilled in the art without departing from the true spirit and scope of the invention as defined by the appended claims.

Figure 3:
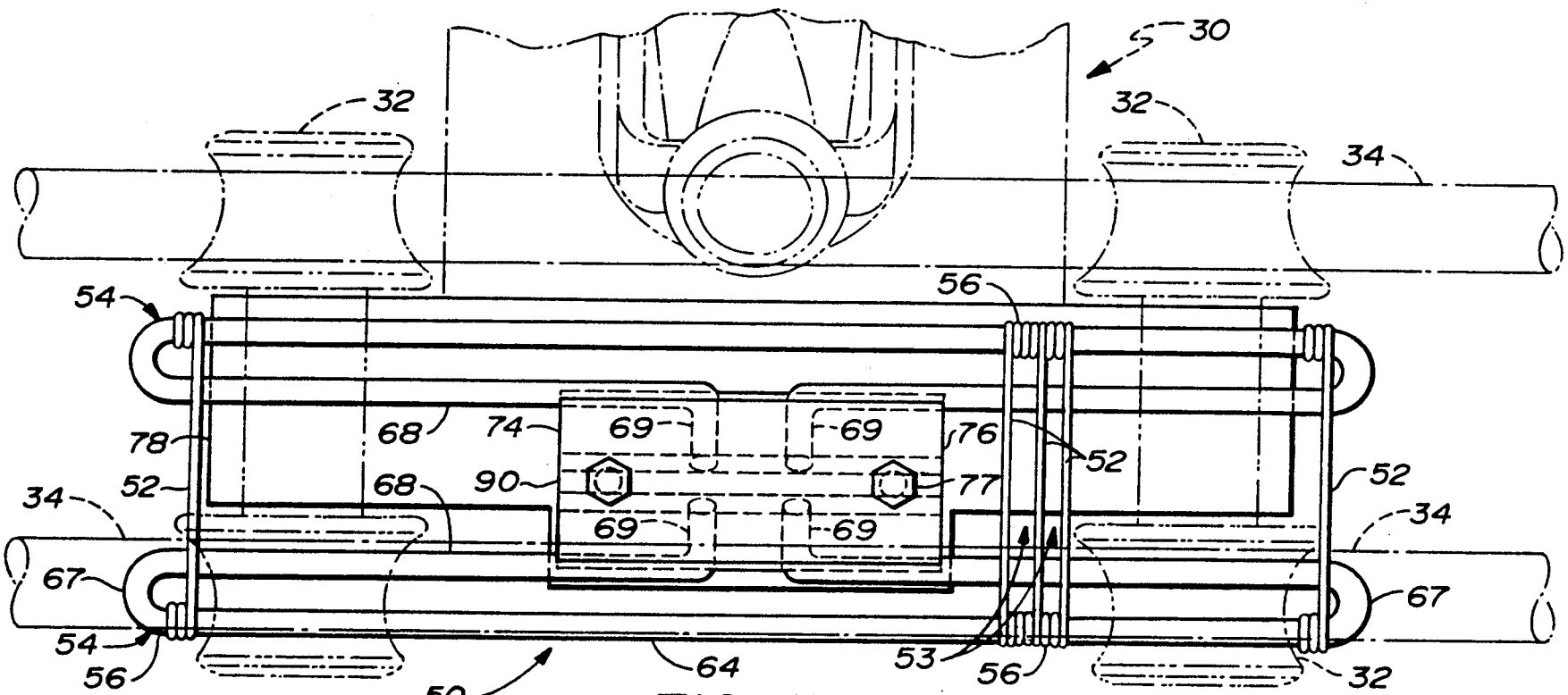
FIG. 3 is an enlarged, fragmentary, top plan view of a resilient traction drive shoe mounted to a detachable grip assembly and constructed in accordance with the present invention.

Turning now to the drawings, wherein like components are designated by like reference numerals throughout the various figures, attention is directed to FIG. 3. Here is provided a drive shoe assembly, generally designated 50, having resiliently flexible traction members, generally designated 52, and mounted to detachable grip assembly 30, shown in phantom lines As previously discussed, the typical detachable grip assembly 30 is well known in the art and is, thus, only partially represented here for the purposes of describing the present invention herein. Detachable grip assembly 30 and its transport or carrier unit 31 (in phantom in FIG. 6) are normally supported at tramway terminals by rolling elements, such as rollers 32 (shown in phantom), which roll on terminal guide rails 34.

Figure 5:
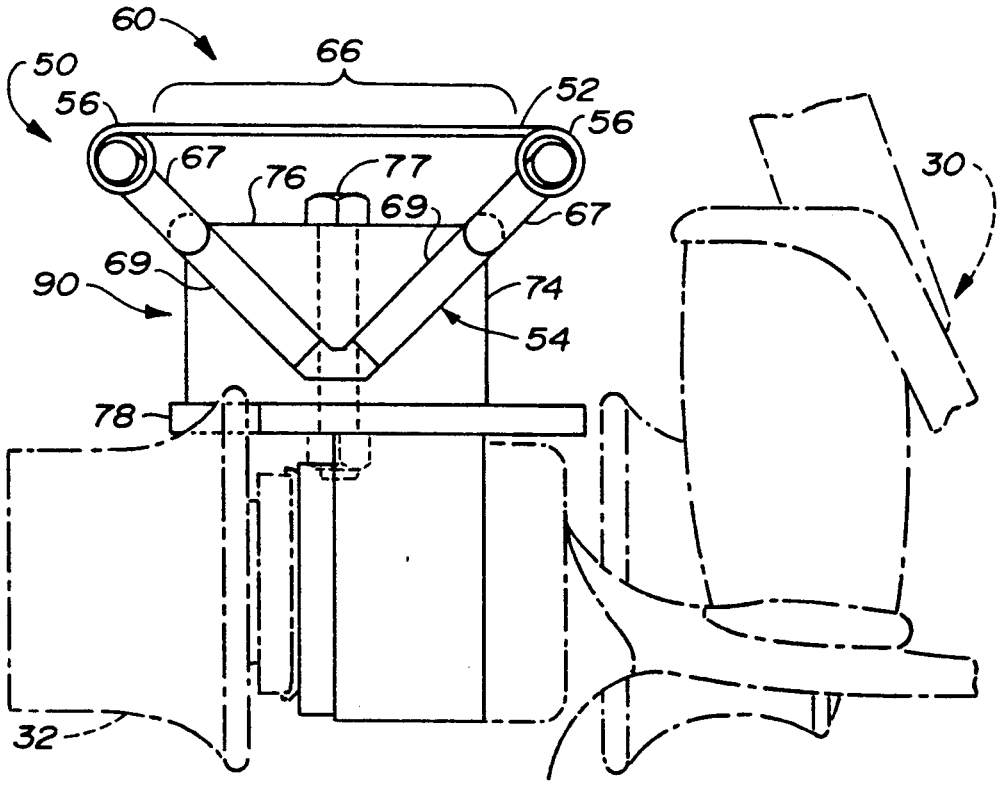
FIG. 5 is a fragmentary, front elevation view of a resilient traction drive shoe corresponding to FIG. 3 and constructed in accordance with the present invention.
Figure 7:
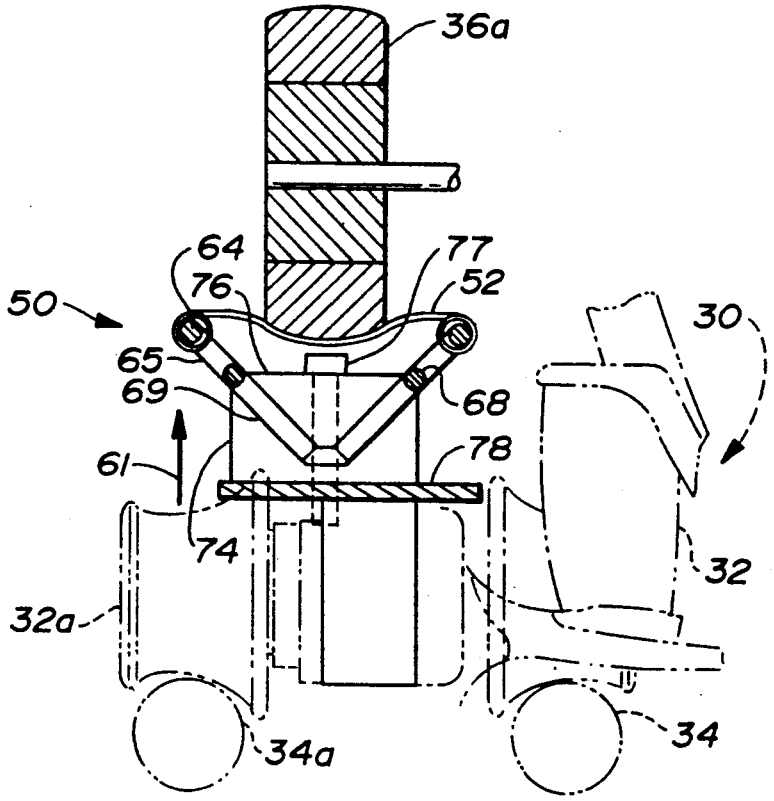
FIG. 7 is a fragmentary, cross-sectional, front elevation view taken substantially along the plane of line 7—7 in FIG. 6.

The improvement in drive shoe assembly 50 is comprised, broadly, of a plurality of resiliently flexible traction members 52 mounted, for example, by frame members 54, to grip assembly 30. Flexible drive shoe members 52 cooperate with frictional drive means, such as drive wheels 36, to propel the transport or carrier unit 31 along rails 34. In the preferred embodiment represented in FIGS. 3–5, frame members 54 are oriented longitudinally in the direction of travel of the transport unit and drive shoe assembly 50. Moreover, resiliently flexible traction members 52 are preferably disposed transversely to frame members 54. Although only a few resilient members 52 are illustrated in FIGS. 3 and 5 for ease of representation, members 52 are generally disposed in an equally spaced side-by-side relation along the entire upper horizontal portion 64 (FIG. 4) of frame members 54. Collectively, the plurality of resilient members 52 define an upwardly facing, resiliently flexible, traction surface, generally designated 60, extending in a direction along a path defined by guide rails 34. Traction surface 60 is sufficiently flexible such that ice present on resilient members 52 will crack and fall away upon flexing of members 52 when engaged by drive wheels 36. This flexing can be seen to be substantial, as is more clearly represented in FIGS. 7 and 8.

Thus, the relative positions of drive wheels 36 and surface 60 of drive shoe assembly 50 is established by their respective mounting structures so that the drive wheels downwardly displace resilient traction members 52 by a significant amount, which breaks up ice spanning or bridging between the various members 52. Since members 52 are held in relatively spaced relation on frame members 54, ice fragments broken by flexing of resilient members 52 are free to fall away from and down between the spaces or passageways 53 between members 52.

The resiliently flexible drive shoe 50 of the present invention acts to both crack and build-up ice in a manner similar to a flexible ice tray, and to permit the cracked ice to fall away from upper traction surface 60.

The maximum coefficient of friction between resilient members 52 and drive wheels 36 is advantageously maintained permitting operation under virtually all conditions without the need for a sweeping device. Consequently, flexible traction surface 60 of the present invention provides a high degree of traction while simultaneously removing traction diminishing ice accumulation from individual resiliently flexible members 52.

Figure 6:
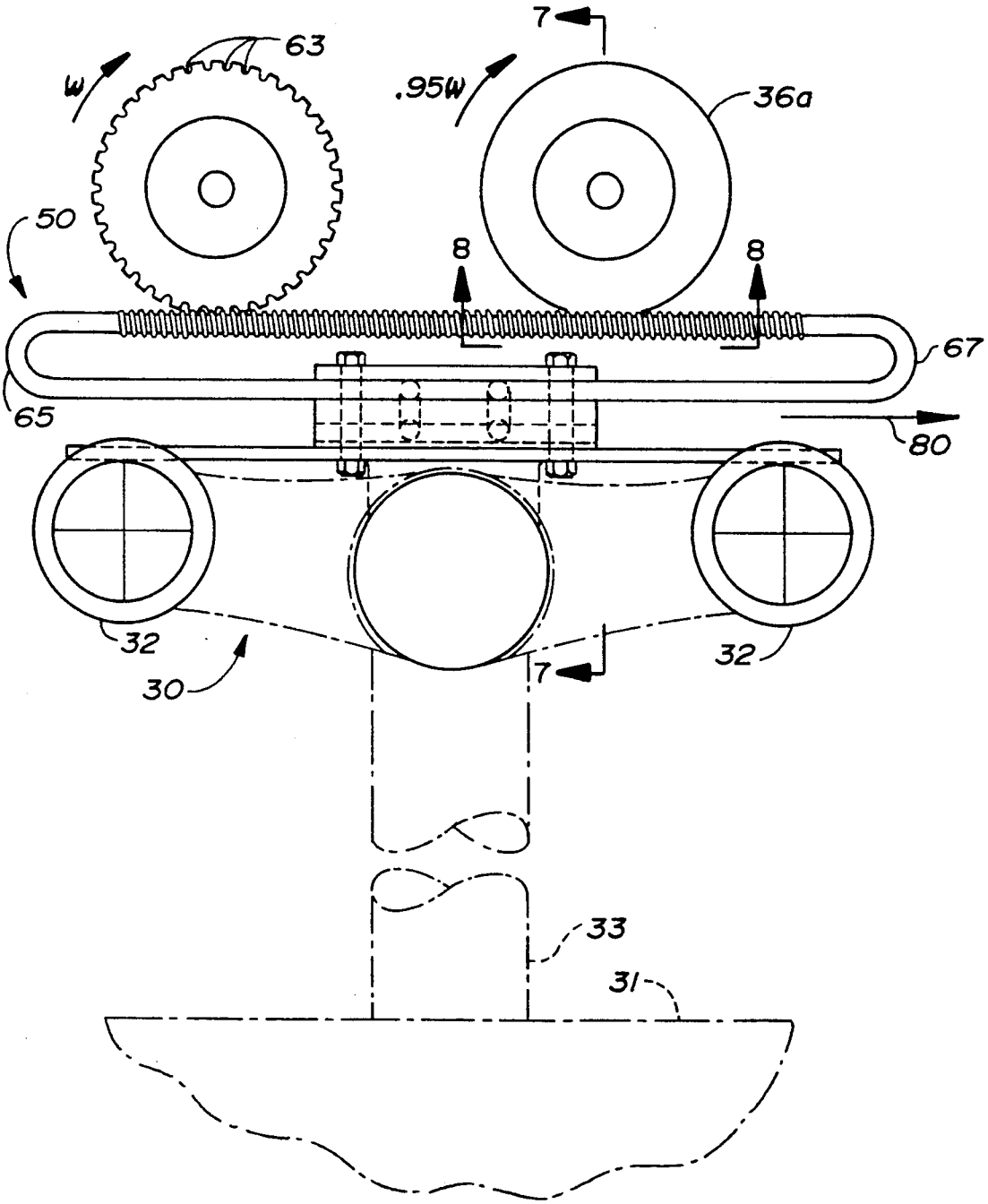
FIG. 6 is a reduced side elevational view of a resilient drive shoe constructed in accordance with the present invention and engaged by two drive wheels.

In essence, the relatively linear portions 66 (FIG. 5) of resilient members 52 which spans the traverse distance between frame members 54 is a leaf spring element. Depending on the composition of resilient members 52, the elastic properties can be predicted. As shown in FIG. 6, wheels 36 rotate in a clockwise manner, and drive shoe assembly 50 is propelled forward in the direction represented by arrow 80. Upon closer inspection, and as further viewed in FIG. 8, when traction surface 60 engages with wheel 36, resiliently flexible members 52 contacting wheel 36 are deflected until their elastic potential energy surpasses the force exerted by wheel 36. At this limit, drive shoe assembly 50 is propelled forward at a linear velocity equivalent to $\omega r$, where $\omega$=angular velocity of the engaging wheel and r=radius of wheel 36. Simultaneously, the deflection of resilient members 52 is sufficient to surpass the elastic limit of ice affixed thereon and the ice is cracked or fractured and is then dislodged. Once member 52 have disengaged with wheel 36, members 52 return to original position in accord with Hooke's Law.

In the embodiment shown in FIGS. 3–8, resilient member 52 is preferably a heavy gauge wire element spanning the transverse distance between frame members 54. However, the present invention is in no way limited to linear elements. Transversely extending coiled springs or a resilient netting could also be effectively deployed, as well as diagonally disposed resilient elements. A resiliently flexible sheet with, for example, traction protrusions, could be employed to fracture the ice, and a brush used to sweep the ice off the sheet. Alternatively a resiliently flexible sheet with openings also could be employed.

As viewed in FIGS. 3 and 5, the ends of resilient members 52 are preferably coiled around the cylindrical perimeter of rod-like frame members 54 which form a cylindrical helical spring portion generally designated 56. The diameter of the helical coils 56 are preformed slightly larger than that of rod-like frame members 54. Accordingly, when resilient members 52 are not deflected, coils 56 are partially free to slide longitudinally along horizontal upper portion 64 of frame members 54.

Figure 8:
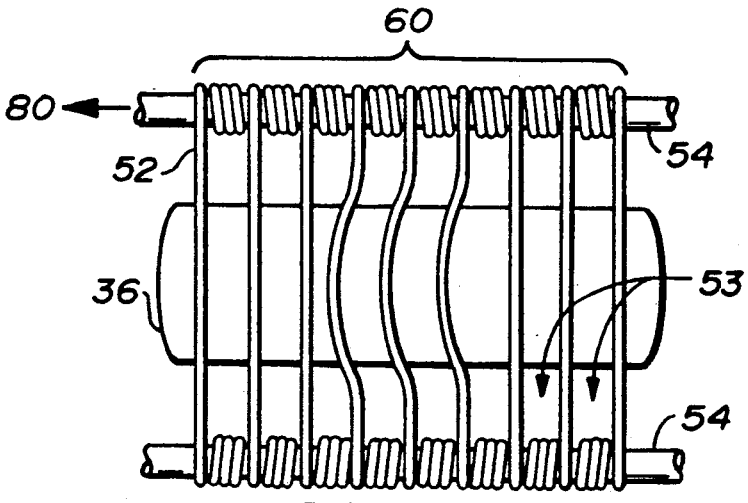
FIG. 8 is a fragmentary, cross-sectional, bottom plan view taken substantially along the plane of line 8—8 in FIG. 6.

Helical spring portions 56 provide three important functions during engagement with frictional drive means 36. First, resiliently flexible elements 52 are preferably disposed in a relatively equally spaced side-by-side fashion. As best seen in FIGS. 6 and 8, coils 56 act as spacers between elements 52. Secondly, helical coils 56 are torsional elements which wind or unwind, maintaining tension on leaf spring portion 66 between frame members 54. Lastly, coils 56, upon unwinding, provide the additional length necessary to permit leaf spring portion 66 to be flexibly displaced when engaged with frictional drive means 36. As mentioned above, frictional engagement with wheels 36 sufficiently deflects resiliently flexible member 53, whereby ice accumulation on element 52 is cracked and falls away. In sum, resiliently flexible members 52 comprise a linear leaf spring portion 66 having torsional helical coil springs 56 on the ends thereof.

Figure 4:
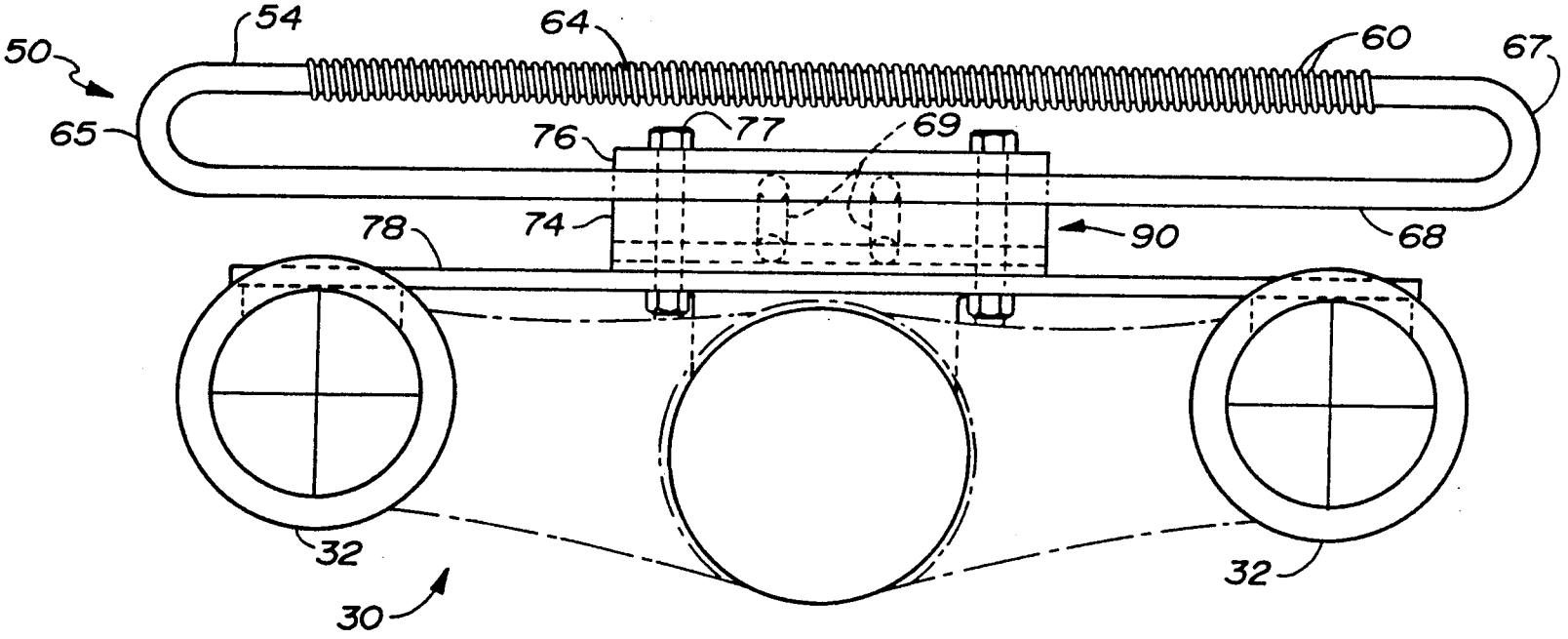
FIG. 4 is a side elevation view of the resilient traction drive shoe of FIG. 3.

Attention is now directed back to FIGS. 3-5 where frame members 54 are preferably comprised of a pair of substantially parallel rod-like loop members having a horizontal upper portion 64 extending longitudinally in a direction along the path. As best viewed in FIG. 4, loop frame members 54 have a rounded front and rear ends, 67 and 65, respectively. Frame members 54 loop back toward the center to provide a lower horizontal portion 68. Resilient members 52 are tensioned between upper portions 64 of frame members 54. Finally, frame members 54 extend innwardly toward one another proximate their end portions 69.

Frame members 54 are releasably mounted to a rigid mounting means, generally designated 90, which, in turn, is affixed to detachable grip assembly 30 by mounting plate or bracket 78.

During fabrication or assembly of shoe assembly 50, a predetermined number of resilient traction members 52 are mounted onto upper horizontal portion 64 of both frame members before frame members 54 are releasably mounted to base 74. As may best be viewed in FIG. 5, in the preferred assembly, all portions of frame members 54 (i.e., ends 69 lower portions 68, curved ends 67 and horizontal upper portions 64) are aligned in a single predetermined plane. Thus, upon fabrication, members 54 are placed side-by-side relation such that the planes containing members 54 are substantially parallel to permit mounting of coils 56 on members 54. Helical coils 56 are strung around the rod-like portion of members 52 until they are mounted on the horizontal upper portion 64 in a side-by-side relatively spaced apart manner. Then the mounting or clamping assembly 90 can be used to clamp frame members 54 in fixed position on the grip assembly.

Resiliently flexible members 52 preferably are slightly pre-loaded or tensioned to prevent spring rattle. In addition, this practice keeps resilient members 52 centered along upper horizontal portion 64 of frames 54. To pre-load leaf spring portion 66, the stepped ends 69 and a portion of lower horizontal portions 68 are mounted to bracket 78 by mounting means 90. Mounting means 90, in the preferred form, comprises a base 74 having a longitudinal V-shaped groove therein and a complimentary wedge-shaped member 76. As clearly viewed in FIG. 5, ends 69 are sandwiched between base 74 and V-shaped member 76, which then forcibly orients the opposing frame members 54, in this case at about 45° from vertical and about 90° with respect to one another. Accordingly, upper frame portions 64, are horizontally separated thereby pulling resilient members 52 tautly apart to tension them against rattling. Fasteners 77 extending vertically therethrough, tighten wedge 76 to base 74 to clamp the frames and pre-load spring members 52.

Figure 1:
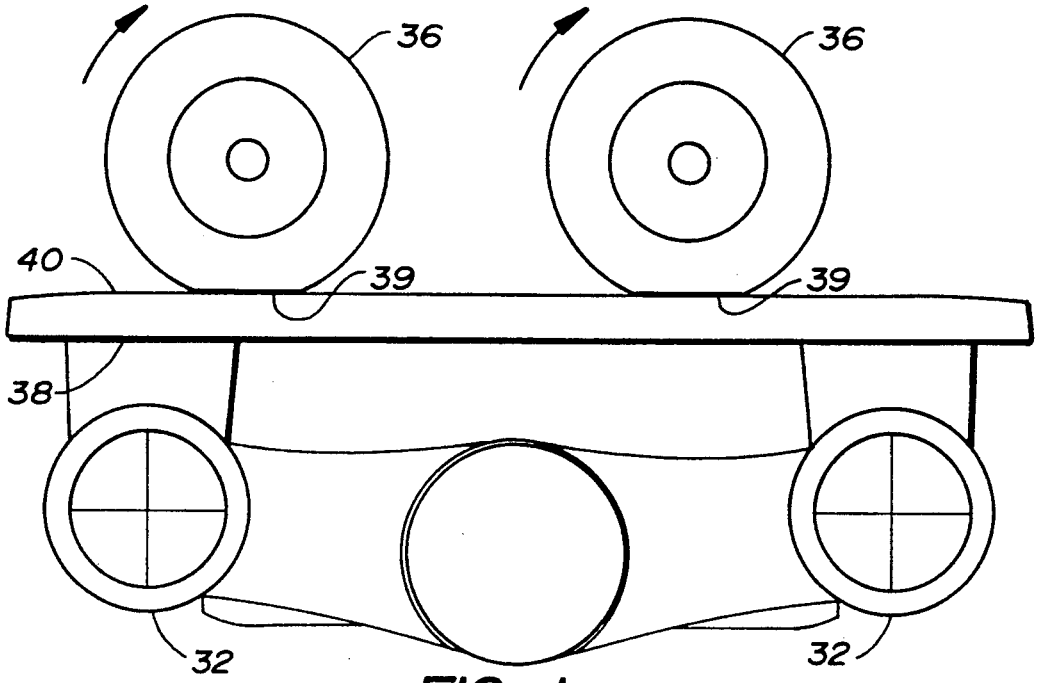
FIG. 1 (PRIOR ART)
FIG. 1 is a side elevation view of a prior art traction drive shoe assembly.
Figure 2:
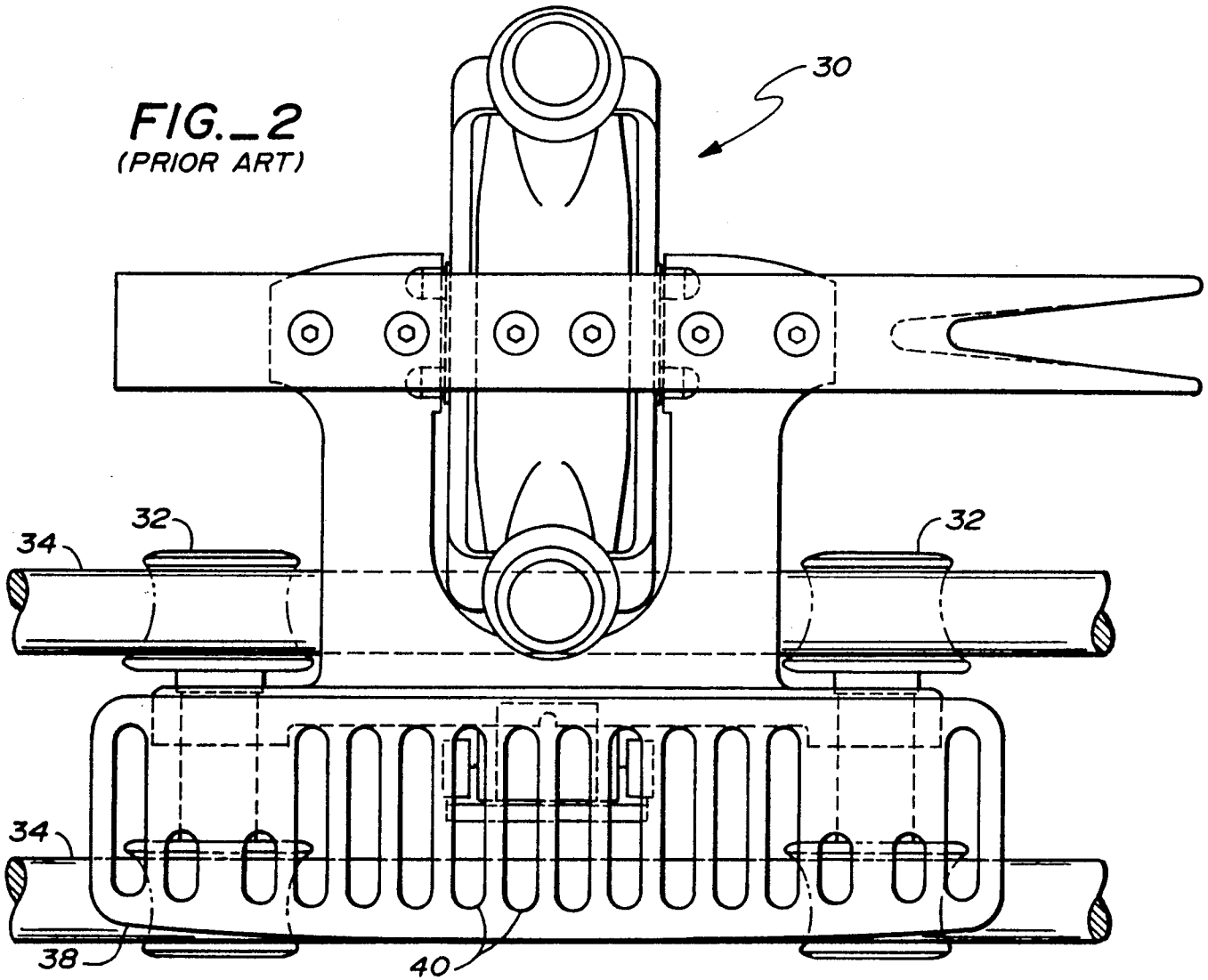
FIG. 2 (PRIOR ART)
FIG. 2 is a top plan view of the assembly of FIG. 1 shown mounted to a detachable grip assembly.

While fracturing and preventing ice build-up is an important feature of the flexible drive shoe assembly of the present invention, drive shoe assembly 50 has other significant advantages which accrue even in warm weather environments. Resiliently flexible traction surface 60 of the present invention is particularly effective in eliminating or accommodating the fighting which would otherwise occur when two consecutive drive wheels 36 operating at different speeds simultaneously engage traction surface 60. As stated above, the angular velocity between consecutive drive wheels 36 in accelerators and decelerator at the entrance or exit of terminals or stations will differ to facilitate acceleration or deceleration upon attachment or detachment of the transport unit from the haul rope. According to the prior art assemblies, shown in FIGS. 1 and 2, slippage occurs at one or the other wheel because prior art drive shoe assembly 38 employs relatively rigid traction surface 40. Although the difference in angular velocity between two consecutive drive wheels 36 may be comparatively small (i.e., less than 10%), significant tire and component wear can be minimized by prevention of this slippage.

Referring now to FIG. 6, drive wheels 36 and 36*a* are shown as having angular velocities $\omega$ and $0.95\omega$, respectively (a decelerator). According to the present invention, however, the angular velocity difference between consecutive drive wheels 36 and 36*a* is absorbed or accommodated through resilient displacement of flexible traction members 52 along the drive path. Traction members 52 absorb the angular velocity difference as elastic potential energy during frictional engagement with wheels 36 and 36*a* and deflection of flexible members 52. In a decelerator grip assembly 30 and cabin or transport unit 31 will be traveling at the speed $\omega r$ as shoe 50 reaches and is controlled by drive wheel 36. When front end 67 reaches shown turning wheel 36*a*, spring members 52 will be stretched in a forward direction to accommodate slower wheel 36*a*. As wheel 36 leaves and 65 of the shoe assembly, wheel 36*a* will dominate and the resilient spring members will allow the shoe and transport cabin to slow to 0.85 $\omega r$. This process is repeated as the shoe moves along the decelerator and the process works in reverse for the accelerator. Instead of accommodating drive wheel velocity differences by slipping, however, the resiliently flexible drive shoe assembly is resiliently displaced above the path until the shoe is free of the adjacent drive wheel. As a result, slippage on traction surface 60 is substantially reduced and, thus, tire and component wear are prolonged.

Another important advantage of the drive shoe and method of the present invention is that, inflatable drive wheels 36 do not need to be employed. As can be seen from FIG. 1, prior art transportation systems have typically employed rigid drive shoes and inflated resilient drive wheels. Thus, the combination of sloped entries and exits on the traction surface and resilient flexing of the inflatable tires, for example, at 39, insured smooth transitioning of the drive shoe from one drive wheel to the next. The problem, however, was that inflatable tires have occasional flats, and even one flat drive wheel, depending on its location, can cause an entire system to have to be shut down for replacement.

By contrast when flexible drive shoes and rigid drive wheels are employed, the flat-tire problem is eliminated and failure of one, or even several flexible springs 52 will not force a transport unit out of service. Moreover, even if many springs should fail, a single transport unit can often be removed from the overall system without shutting down the system.

Moreover and very importantly, the resiliently flexible shoe assembly of the present invention will afford damping of the lateral swinging or sway of the transport unit as it enters the end terminals. In aerial tramways, it is not uncommon for the haul rope conveyed unit to swing or sway transversely to the haul rope, for example, as a result of the movement or shifting of people in the unit. When the transport unit reaches the end terminals and rails 34, this swinging can cause one of the inside or outside rollers 32 to be lifted off of rails 34. In prior art systems the inflated tire would resiliently damp any tendency of roller 32*a* to lift up off rail 34*a*, in FIG. 7, and rotate about the other rail 32. This lateral moment about rail 32 is induced by swinging of cabin 31 on hanger arm 33 (FIG. 6), and as indicated by arrow 1 in FIG. 7. In the present invention solid tire 36*a* is preferably employed, but resiliently flexible traction shoe 50 effectively damps, or resiliently resists, motion in the direction of arrow 61 or a reverse moment tending to lift roller 32 and rotate the assembly counterclockwise about rail 34*a*.

Another significant advantage of the resiliently flexible shoe assembly of the present invention is that the spaced apart spring or traction members 52 can be used with transversely grooved drive wheels 36. For example, as seen in FIG. 6, drive wheel 36 is formed with transverse grooves 63 dimensioned to receive central portions 66 of resilient traction members 52. Circumferential spacing of grooves 63 preferably substantially matches the spacing of members 52, although it will be understood that other spacings can be employed (e.g., every other member or even random spacings).

As the drive shoe is engaged by a grooved drive wheel, there will be some relative slipping, until a spring member seats or is resiliently urged into a groove. Once seated the coupling between the drive wheel and shoe is more positive, although still resilient as a result of the resiliency of members 52. Grooved wheels are particularly advantageous when propelling transport units along grades, and either alternating or even sequentially adjacent grooved wheels can be used.

As will be seen from the above description of the assembly of the present invention, the method of preventing the accumulation of ice and other debris buildup from traction surface 60 of drive shoe assembly 50 of the present invention include the step of mounting a drive shoe assembly have a resilient, flexible traction surface 60 to a transport unit. Deflection of resilient traction members 52 fractures any built-up ice affixed to the exterior of shoe members 52 and it is able to fall away from the drive shoe.

The method and assembly of the present invention enables usage of uninflated or solid tires which are relatively rigid. In the preferred embodiment, wheels 36 have solid rubber tires similar to those employed in forklifts.

The present method also includes accommodating drive wheel acceleration and deceleration by providing a drive shoe which is resiliently flexible in a direction along the drive path.

In another aspect of the present method positive and yet resilient driving of the transport unit is achieved by providing relatively rigid drive wheels 36 may include a plurality of transverse grooves 63 positioned in circumferentially spaced apart relation. These grooves are formed to engage with resilient members 52 facilitating traction upon frictional engagement with traction surface 60. Once wheel 36 contacts traction surface 60, individual resilient members 52 cooperate with transverse grooves 63 by interengaging with these grooves to further increase traction capabilities.

In a final aspect of the present method a resiliently flexible drive shoe assembly is provided to damp lateral swinging of the transport unit as it enters the guide rails.

While in the foregoing specification the present invention has been described in relation to certain preferred embodiments thereof, and many details have been set forth for purposes of illustration, it will be apparent to those skilled in the art that the invention is susceptible to additional embodiments and that certain of the details described herein can be varied considerably with out departing from the basic principles of the invention.

What is claimed is:

1. In a drive shoe assembly formed for mounting on transport means, said drive shoe assembly including traction means formed to cooperate with frictional drive means to propel said transport means along a path, an improvement in said drive shoe assembly comprising:

said traction means including a resiliently flexible traction surface having a length dimension extending along said path and a width dimension extending transversely of said path and defined between opposed sides of said traction surface, said traction surface being resiliently flexible across said width dimension between said sides of said traction surface.

2. The drive shoe assembly as defined in claim 1 wherein, said traction surface is formed with passageways extending through said drive shoe assembly, and is sufficiently flexible to produce cracking and falling away of any ice present on said traction surface upon frictional engagement and flexing of said traction surface by said frictional drive means.

3. The drive shoe assembly as defined in claim 1 wherein.

said traction surface is comprised of a plurality of side-by-side relatively spaced resiliently flexible elements, said elements being resiliently flexible independently of each other both across said width dimension and along said length dimension.

4. In a drive shoe assembly for mounting to a movable transport means, said drive shoe assembly including frame means, traction means mounted to said frame means and providing a traction surface formed to cooperate with a drive means for frictional propulsion of said transport means along a path, an improvement in said drive shoe assembly comprising:

said frame means including at least two substantially spaced apart frame portions extending in a direction along said path; and said traction means being a resiliently flexible assembly extending transversely to said path between said frame portions and providing said traction surface.

5. The drive shoe assembly as defined in claim 4 wherein, said traction means is provided by a plurality of individual spring elements positioned in a spaced apart relation and supported between said frame portions.

6. The drive shoe assembly as defined in claim 5 wherein, said spring elements are slidably mounted to said frame portions.

7. The drive assembly as defied in claim 6 wherein, said spring elements have coiled ends extending around said portions.

8. The drive assembly as defied in claim 6 wherein, said frame portions are releasably mounted to mounting means for mounting of said spring elements to said frame portions, said means mounting said frame portions in sufficiently spaced apart relation to tension said spring elements.

9. The drive assembly as defined in claim 8 wherein, said mounting means comprises a grooved base and a V-shaped wedge element releasably secured to said base, and said frame portions include frame members clamped between said base and said wedge element.

10. The drive assembly as defined in claim 5 wherein, said frame portions are loop-like members with rounded opposing entry and exit portions and with inwardly extending end portions, said opposing entry and exit portions and said end portions all being aligned in a common plane.

11. The drive assembly as defined in claim 2 wherein, said drive shoe assembly is mounted to a detachable haul rope grip assembly in an orientation and position for support of snow on said traction surface.

12. A transportation system comprising:

at least one transport means;

a drive shoe assembly mounted to said transport means and having only one resiliently flexible traction surface facing outwardly from one side of said drive shoe assembly; and a solid drive wheel positioned to engage said only one traction surface of said drive shoe assembly only on said one side of said drive shoe assembly and formed to propel said transport means along a path.

13. The transportation system as defined in claim 12 wherein, said frictional drive means is comprised of a plurality of sequentially arranged solid uninflated drive wheels each positioned to engage said one side of said drive shoe assembly.

14. The transportation system as defined in claim 13 wherein, said traction surface is provided by a plurality of side-by-side resiliently flexible members mounted to extend transversely to said path and defining passageways through said drive shoe assembly.

15. The transportation system as defined in claim 12 wherein, said resiliently flexible traction surface is formed with resiliently flexible portions adapted for flexure independently of other flexible portions in a direction along said path.

16. The transportation system as defined in claim 15 wherein, said resiliently flexible traction surface is formed with resiliently flexible portions adapted for flexure independently of other flexible portions in a direction away from said frictional drive means and transversely across said path.

17. The transportation system as defined in claim 16 wherein, said drive shoe assembly is positioned and oriented for the accumulation of snow thereon, and said frictional drive means is positioned relative to said drive shoe assembly to flex said traction surface by an amount sufficient to exceed the elastic limit of ice on said traction surface.

18. The transportation system as defined in claim 17 wherein, said drive shoe assembly includes a plurality of spaced apart, side-by-side resilient members defining passageways extending through said drive shoe assembly; and said frictional drive means is provided by a plurality of drive wheels sequentially arranged along said path.

19. The transportation system as defined in claim 12, and, guide rail means extending along said path at an aerial tramway terminal; and wherein, said transport means is an aerial tramway carrier unit having a grip assembly formed for selective attachment to and detachment from a haul rope; and said drive shoe assembly is mounted to one of said carrier unit and said grip assembly.

20. The transportation system as defined in claim 19 wherein, said drive shoe assembly is mounted to said grip assembly;

said resiliently flexible traction surface is provided by a plurality of spaced apart resiliently flexible traction members defining passageways through said drive shoe assembly; and said frictional drive means is provided by a plurality of relatively solid uninflated drive wheels mounted to sequentially engage said drive shoe assembly as said carrier unit is propelled along said rail means.

21. In a detachable haul rope grip assembly for an aerial tramway, said grip assembly including means for releasably gripping a haul rope and a drive shoe assembly positioned for sequential engagement by drive wheels positioned along a path, an improvement in said grip assembly comprising:

said drive shoe assembly including a resiliently flexible traction means having a length dimension along said path and a plurality of traction surface portions in side-by-side relation over said length dimension, said traction means being mounted to said grip assembly and said traction surface portions being independently resiliently flexible in a direction along said path, in a direction traversing said path, and in a direction toward and away from said drive wheels.

22. The drive assembly as defined in claim 21 wherein, said traction means is provided by a plurality of spring elements positioned in a spaced apart relation to define passageways through said traction means, said spring elements extending transversely to said path.

23. A method of providing a drive system for a transportation system which drive system will not build-up ice on a traction surface used to propel a transport unit comprising:

mounting a resiliently flexible traction surface, having flexibility in a direction traversing the travel path of the transport unit, to a transport unit in an orientation and position supporting snow on said traction surface, said traction surface further being mounted for engagement and sufficient displacement of said traction surface by a drive assembly to flex said traction surface beyond the elastic limit of ice forming from said snow on said traction surface.

24. A method of providing a drive system as defined in claim 23 wherein, said mounting is accomplished by mounting a plurality of resiliently flexible spring elements to said transport unit in spaced apart relation defining passageways extending through said traction surface.

25. A method for accommodating engagement of a drive shoe assembly with at least two drive wheels of a transportation system operating at differing angular velocities comprising:

providing a drive shoe having a traction surface having a plurality of resiliently flexible surface portions formed for flexure independently of each other in a direction extending along a path between said drive wheels and in a direction traversing said path.

26. A method in a vehicle as defined in claim 25 wherein, said providing is accomplished by mounting a drive shoe having a plurality of resiliently flexible independent spring elements on a transport unit.

27. A method of damping lateral swinging of an aerial tramway carrier unit as said carrier unit enters a terminal is detached from a haul rope and is movably supported on guide rails comprising:

providing a resiliently flexible drive shoe assembly on said carrier unit said drive shoe assembly having only one traction surface on one side of said drive shoe assembly;

engaging said drive shoe assembly only on said one side with a drive wheel as said carrier unit enters said terminal; and urging said carrier unit into supporting engagement with said guide rails by resilient flexing of said drive shoe assembly.

28. A transportation system comprising:

at least one transport means movably supported for driving along a path;

a drive shoe assembly mounted to said transport means and having ar siliently flexible traction surface provided by a plurality of side-by-side resiliently flexible members mounted to extend transversely of said path;

a plurality of sequentially arranged drive wheels positioned to engage said drive shoe assembly; and at least one of said drive wheels being formed with a plurality of circumferentially spaced transversely extending grooves dimensioned to receive said flexible members.

* * * * *